US009311879B2

(12) United States Patent
Park

(10) Patent No.: US 9,311,879 B2
(45) Date of Patent: Apr. 12, 2016

(54) LIQUID CRYSTAL DISPLAY DEVICE AND DRIVING METHOD THEREOF

(71) Applicant: LG DISPLAY CO., LTD., Seoul (KR)

(72) Inventor: Yong Hwa Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 267 days.

(21) Appl. No.: 14/055,199

(22) Filed: Oct. 16, 2013

(65) Prior Publication Data

US 2014/0176521 A1 Jun. 26, 2014

(30) Foreign Application Priority Data

Dec. 24, 2012 (KR) ..... 10-2012-0152512

(51) Int. Cl.
*G09G 3/36* (2006.01)

(52) U.S. Cl.
CPC ..... *G09G 3/3677* (2013.01); *G09G 3/3655* (2013.01); *G09G 3/3614* (2013.01); *G09G 2300/0408* (2013.01); *G09G 2310/0224* (2013.01)

(58) Field of Classification Search
CPC ..... G09G 2300/0823; G09G 2310/027; G09G 2310/0272; G09G 2310/0278; G09G 3/3614; G09G 2310/068; G09G 3/3611; G09G 3/3674; G09G 3/3696
USPC ..... 345/87–89, 98, 100, 204
See application file for complete search history.

(56) References Cited

U.S. PATENT DOCUMENTS

2006/0007193 A1* 1/2006 Yamashita ..... G09G 3/3666 345/204
2007/0262940 A1* 11/2007 Morimoto ..... G09G 3/3614 345/94
2008/0309590 A1* 12/2008 Hong ..... G09G 3/3614 345/52
2009/0219241 A1 9/2009 Tamura et al.
2010/0127960 A1 5/2010 Jung et al.

FOREIGN PATENT DOCUMENTS

JP H11-119743 A 4/1999

* cited by examiner

*Primary Examiner* — Jennifer Nguyen
(74) *Attorney, Agent, or Firm* — Brinks Gilson & Lione

(57) ABSTRACT

Disclosed is an LCD device. The LCD device comprises a panel, a data driver configured to output a data voltage to a data line; a gate driver configured to sequentially output a scan signal to a plurality of gate lines, a common electrode formed at the panel in correspondence with each of the pixels, a common voltage generator configured to generate a common voltage to be supplied to the common electrode, a timing controller configured to output a first selection signal or a second selection signal, and a selector configured to output a correction common voltage corresponding to a negative liquid crystal driving voltage or the common voltage to the common electrode by using the scan signal, the first selection signal, or the second selection signal.

10 Claims, 8 Drawing Sheets

LIQUID CRYSTAL DISPLAY DEVICE AND DRIVING METHOD THEREOF

CROSS-REFERENCE TO RELATED APPLICATIONS

This application claims the benefit of the Korean Patent Application No. 10-2012-0152512 filed on Dec. 24, 2012, which is hereby incorporated by reference as if fully set forth herein.

BACKGROUND

1. Field of the Disclosure

The present disclosure relates to a liquid crystal display (LCD) device, and more particularly, to an LCD device and a driving method thereof which periodically switch between a negative polarity and positive polarity of data voltages. 2. Discussion of the Related Art Flat panel display (FPD) devices are used in various electronic devices such as portable phones, tablet personal computers (PCs), notebook computers, etc. The FPD devices include liquid crystal display (LCD) devices, plasma display panels (PDPs), organic light emitting diode (OLED) display devices, etc. Recently, electrophoretic display (EPD) devices are being widely used as the FPD devices.

In the FPD devices, especially, LCD devices can be used in all electronic devices ranging from small devices to large devices, and thus are being widely used.

FIG. 1 is an exemplary diagram for describing a related art method of driving an LCD device, and shows waveforms of a common voltage Vcom, a data voltage Vdata, and a gate voltage Vgate.

LCD devices of the related art use various inversion systems such as a frame inversion system, a line inversion system, a column inversion system, and a dot inversion system, for preventing liquid crystal from being deteriorated when one-way electric field is applied to a liquid crystal cell for a long time.

In a case using the above-described inversion systems, data voltages Vdata outputted to respective data lines are switched from a negative polarity to a positive polarity or from the positive polarity to the negative polarity in units of a line or in units of a frame.

That is, the related art LCD devices repeat an operation in which data voltages Vdata are switched from a positive (+) polarity to a negative (−) polarity and then again switched from the negative (−) polarity to the positive (+) polarity, with respect to a common voltage Vcom.

For example, as shown in FIG. 1, a data voltage (Odd Line Vdata) outputted to an odd-numbered gate line is outputted as the positive (+) polarity during a first frame period, and then outputted as the negative (−) polarity during a second frame period.

In this case, a data voltage (Even Line Vdata) outputted to a line corresponding to an even-numbered gate line is outputted as the negative (−) polarity during the first frame period, and then outputted as the positive (+) polarity during the second frame period.

An inversion system, which outputs data voltages in this way, is generally called the line inversion system.

As described above, when a data voltage Vdata swings with respect to the common voltage Vcom, an input voltage Vdd higher by two times than a liquid crystal driving voltage is needed. Here, the liquid crystal driving voltage denotes a voltage which is required to output light by driving liquid crystal, and the input voltage Vdd denotes a voltage which is required to generate a data voltage Vdata substantially outputted to a data line for diving the liquid crystal.

For example, as shown in FIG. 1, when the liquid crystal driving voltage required to output a negative (−) data voltage or a positive (+) data voltage with respect to the common voltage is 8 V, it is required to supply the input voltage Vdd of 16 V to a data driver which outputs the data voltages, for alternately outputting the positive (+) data voltage and the negative (−) data voltage.

That is, although the liquid crystal driving voltage (a liquid crystal driving voltage (+) or a liquid crystal driving voltage (−)) substantially required to drive the liquid crystal is 8 V, as shown in FIG. 1, when data voltages swing, a difference voltage between a data voltage having the negative (−) polarity and a data voltage having the positive (+) polarity is 16 V, and thus, it is required to supply the input voltage Vdd of 16 V to a source driving IC that outputs the data voltages.

Therefore, in the related art LCD devices, when high-voltage driving is performed, the driving voltage Vdd increases by two times as the liquid crystal driving voltage increases.

When the liquid crystal driving voltage increase by 8 V, the input voltage Vdd increases by 16 V two times 8 V. Therefore, in an LCD device in which the liquid crystal driving voltage is set to 16 V (existing 8 V+8 V↑), the input voltage Vdd of 32 V (existing 16 V+16 V↑) is needed.

In this case, a related art source driving IC supported up to 16 V cannot be used, and a high-voltage source driving IC (S/D-IC) supported up to 32 V should be provided.

When it is assumed that a general high-voltage source driving IC (S/D-IC), which was developed in the past and is being used, uses 22 V as the input voltage Vdd, the maximum liquid crystal driving voltage "Vdd/2" drivable by the related art high-voltage source driving IC (S/D-IC) is "11V(existing 8V+3V↑)" (i.e., Vdd/2=11V(existing 8V+3V↑)). Therefore, in a case using the related art high-voltage source driving IC (S/D-IC), which is available when the maximum liquid crystal driving voltage is 11 V, the liquid crystal driving voltage can increase by only a maximum of 3 V with respect to the existing 8 V.

As LCD devices enlarge in size and become higher in definition, the liquid crystal driving voltage increases, and thus, the input voltage Vdd supplied to the source driving IC also increases.

However, since an input voltage applicable to the related art high-voltage source driving IC is limited, a new high-voltage source driving IC should be developed each time the liquid crystal driving voltage increases.

For this reason, the overall manufacturing cost of LCD devices increases inevitably, and source driving ICs which were previously used should be discarded.

SUMMARY

An LCD device includes: a panel configured to include a plurality of pixels that are respectively formed in a plurality of areas defined by intersections between a plurality of gate lines and a plurality of data lines; a data driver configured to output a data voltage to a corresponding data line; a gate driver configured to sequentially output a scan signal to the plurality of gate lines; a common electrode formed at the panel in correspondence with each of the pixels; a common voltage generator configured to generate a common voltage to be supplied to the common electrode; a timing controller configured to, when the data voltage to be outputted to the data line has a positive polarity with respect to the common voltage, output a first selection signal and, when the data voltage has a negative polarity with respect to the common voltage, output a second selection signal; and a selector configured to output a correction common voltage corresponding to a negative liquid crystal driving voltage or the common voltage, transferred from the common voltage generator, to the common electrode by using the scan signal, the first selection signal, or the second selection signal.

In another aspect of the present invention, there is provided a method of driving an LCD device, including: when a data voltage to be outputted to a data line has a positive polarity with respect to a common voltage, generating a first selection signal and, when the data voltage has a negative polarity with respect to the common voltage, generating a second selection signal; and generating a correction common voltage corresponding to a negative liquid crystal driving voltage or the common voltage to a common electrode by using a scan signal outputted to a gate line, the first selection signal, or the second selection signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
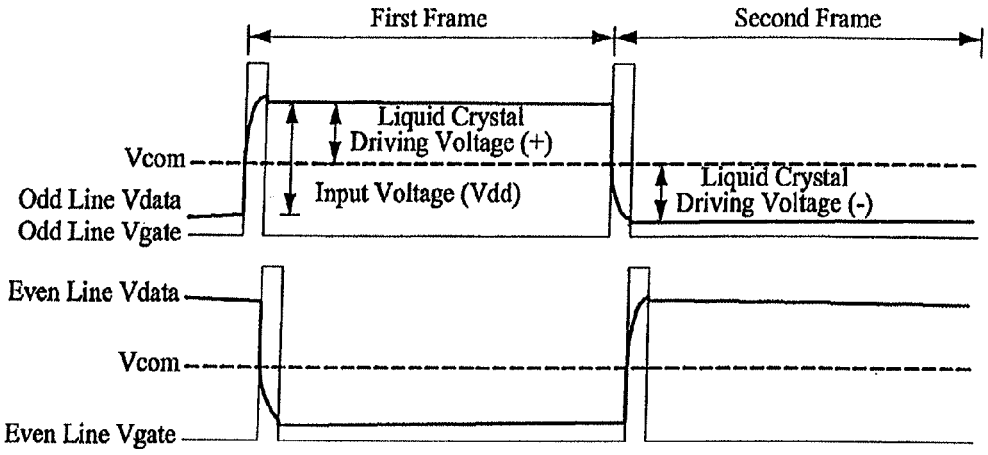
FIG. 1 Related Art
FIG. 1 is an exemplary diagram for describing a related art method of driving an LCD device.
Figure 2:
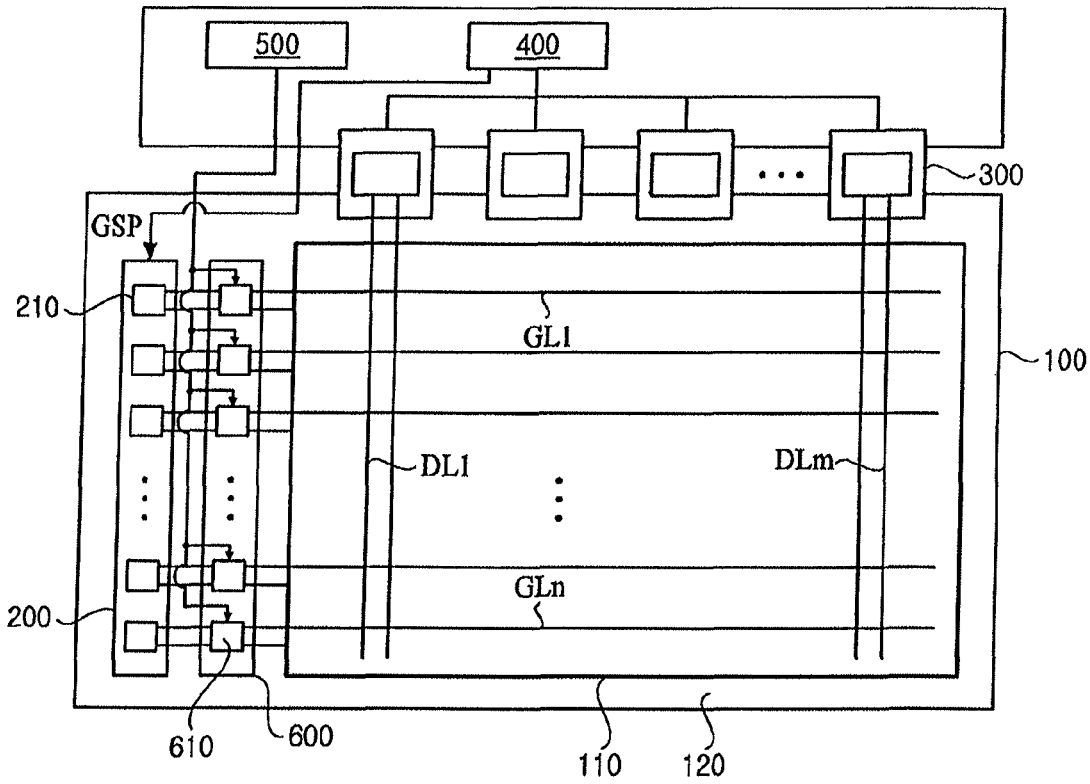
FIG. 2 is a block diagram illustrating an embodiment of an LCD device according to the present invention.
Figure 3:
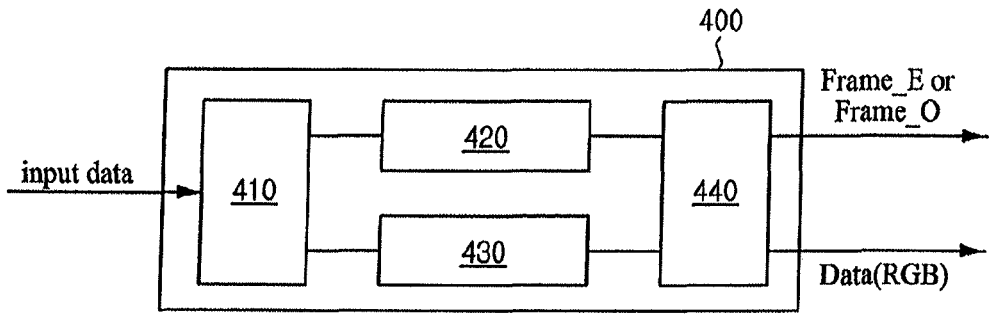
FIG. 3 is a block diagram illustrating an embodiment of a timing controller of FIG. 2.

FIG. 2 is a block diagram illustrating an embodiment of an LCD device according to the present invention, and FIG. 3 is a block diagram illustrating an embodiment of a timing controller of FIG. 2.

As described above in the background art, an LCD device applies a positive (+)/negative (−) data voltage Vdata with respect to a common voltage Vcom to drive liquid crystal. Therefore, the LCD device needs an input voltage Vdd two times a liquid crystal driving voltage.

Even when high-voltage driving is performed, the driving voltage Vdd increases by two times as the liquid crystal driving voltage increases. For this reason, the LCD device has a limitation of high-voltage driving, and in high-voltage driving, the power consumption of the LCD device also increases.

The present invention is for preventing the power consumption of the LCD device from increasing in high-voltage driving. That is, when a data voltage having a positive (+) polarity with respect to the common voltage is outputted, the present invention decreases both the common voltage and the data voltage, thus reducing the power consumption of a data driver.

Moreover, the present invention can identically use the liquid crystal driving voltage and the input voltage Vdd by using a scheme that applies a positive (+) voltage through charge pumping.

Here, the liquid crystal driving voltage denotes a voltage which is required to output light by driving liquid crystal, and the input voltage Vdd denotes a voltage which is required to generate a data voltage Vdata substantially outputted to a data line for diving the liquid crystal. That is, when a voltage substantially necessary for driving of liquid crystal is 8 V, 8 V becomes the liquid crystal driving voltage.

In this case, as described above, since a data voltage swings between a positive (+) polarity and a negative (−) polarity with respect to the common voltage, a voltage difference of 16 V occurs between a positive (+) data voltage and a negative (−) data voltage.

Therefore, only when the data driver can generate 16 V, as described above, a data voltage can swing between the positive (+) polarity and the negative (−) polarity. 16 V that is a voltage difference between the positive (+) data voltage and the negative (−) data voltage becomes the input voltage Vdd. That is, the input voltage Vdd is a voltage that should be inputted to the data driver for generating the data voltage.

To this end, as illustrated in FIG. 2, an LCD device according to the present invention includes: a panel 100 in which a plurality of pixels are formed in respective areas defined by intersections between a plurality of gate lines GL1 to GLn and a plurality of data lines DL1 to DLm; a data driver 300 that outputs data voltages to the respective data lines; a gate driver 200 that sequentially outputs a scan signal to the gate lines; a common electrode 110 that is formed at the panel 100 in correspondence with each of the pixels; a common voltage generator 500 that generates a common voltage to be supplied to the common electrode 110; a timing controller 400 that, when a data voltage to be outputted to a corresponding data line has the positive (+) polarity with respect to the common voltage, outputs a first selection signal, and when the data voltage has the negative (−) polarity with respect to the common voltage, outputs a second selection signal; and a selector 600 that outputs a correction common voltage corresponding to a negative (−) liquid crystal driving voltage or the common voltage (transferred from the common voltage generator 500) to the common electrode 110 by using the scan signal, the first selection signal, or the second selection signal.

The panel 100 includes a thin film transistor (TFT) and a pixel electrode which are formed in each of the areas defined by intersections between the plurality of gate lines GL1 to GLn and the plurality of data lines DL1 to DLm.

The TFT supplies a data voltage applied through a corresponding data line to the pixel electrode in response to the scan signal applied through a corresponding gate line. The pixel electrode drives liquid crystal between the pixel electrode and the common electrode in response to the data voltage, thereby adjusting a light transmittance.

The panel 100 of the present invention may be applied to all liquid crystal modes in addition to a twisted nematic (TN) mode, a vertical alignment (VA) mode, an in-plane switching (IPS) mode, and a fringe field switching (FFS) mode. Also, the LCD device according to the present invention may be implemented as a transmissive LCD device, a semi-transmissive LCD device, a reflective LCD device, or the like.

The gate driver 200 sequentially supplies the scan signal to the gate lines by using gate control signals GCS generated by the timing controller 400.

To this end, the gate driver 200 may be configured with at least one or more gate driving ICs.

Moreover, as illustrated in FIG. 2, the gate driver 200 includes a plurality of stages 210 for sequentially supplying the scan signal to the gate lines.

The number of stages 210 may correspond to the number of gate lines formed in the panel 100.

That is, each of the stages 210 outputs the scan signal to a corresponding gate line formed in the panel 100. In detail, each of the stages 210 subsequent to a first stage 210 is driven by the scan signal applied from a previous stage to supply the scan signal to a corresponding gate line.

The stages 210 may use a stage which is generally used at present. Thus, a detailed description on a configuration and function of the stages 210 is not provided.

The gate driver 200 may be provided independently from the panel 100, and connected to the panel 100 with a tape carrier package (TCP), a flexible printed circuit board (FPCB), or the like. Alternatively, the gate driver 200 may be provided in a gate-in panel (GIP) type which is built into the panel 100. Hereinafter, the present invention will be described with a case, in which the gate driver 200 is provided in the GIP type, as an example.

The scan signal outputted from the gate driver 200 includes a gate-on signal for turning on the TFT connected to the gate line and a gate-off signal for turning off the TFT.

When the TFT is an N type, the gate-on signal is a high-level voltage, and the gate-off signal is a low-level voltage. When the TFT is a P type, the gate-on signal is the low-level voltage, and the gate-off signal is the high-level voltage.

The data driver 300 converts digital image data transferred from the timing controller 400 into data voltages, and supplies the data voltages for one horizontal line to the data lines at every one horizontal period in which the scan signal is supplied to a corresponding gate line.

The data driver 300, as illustrated in FIG. 2, may be configured with at least one or more source driving ICs 300 which are connected to the panel 100 in a chip-on film (COF) type. Hereinafter, the data driver 300 denotes each of the source driving ICs 300.

That is, the data driver 300 converts the image data into the data voltages by using gamma voltages supplied from a gamma voltage generator (not shown), and outputs the data voltages to the respective data lines. To this end, the data driver 300 includes a shift register, a latch, a digital-to-analog converter (DAC), and an output buffer.

The shift register generates a plurality of sampling signals by using data control signals (SSC, SSP, etc.) received from the timing controller 400.

The latch latches the digital image data sequentially received from the timing controller 400, and then simultaneously outputs the latched image data to the DAC.

The DAC simultaneously converts the image data, transferred from the latch, into positive or negative data voltages, and outputs the positive or negative data voltages. Specifically, the DAC converts the image data into the positive or negative data voltages (data signals) according to a polarity control signal POL transferred from the timing controller 400 by using the gamma voltage supplied from the gamma voltage generator (not shown), and outputs the positive or negative data voltages to the respective data lines. In this case, the gamma voltage generator converts the image data into the data voltages by using the input voltage Vdd.

The gamma voltage generator supplying the gamma voltages to the DAC may be configured to output only a negative (−) data voltage. That is, in the present invention, a data voltage to be outputted as the positive (+) polarity is outputted as a negative (−) data voltage, and thus, the gamma voltage generator may be configured to output only the negative (−) data voltage.

The gamma voltage generator performing the above-described function is generally used at present, and thus, its detailed description is not provided.

The output buffer outputs the positive or negative data voltages, transferred from the DAC, to the respective data lines DL of the panel 100 according to a source output enable signal (SOE) transferred from the timing controller 400.

The common voltage generator 500 generates power necessary for the respective elements by using power supplied from an external system.

Particularly, the common voltage generator 500 generates the common voltage to be supplied to the common electrode 110. The common voltage may be supplied to the common electrode 110 through the selector 600.

The common electrode 110 is formed in correspondence with the pixel electrode formed in each pixel of the panel 100. The common electrode may be formed in a plate shape all over the panel 100, but the present invention is not limited thereto. Therefore, the common electrode may be formed in various shapes at the panel 100.

The common electrode 110 may be connected to the selector 600, and may receive the common voltage transferred from the common voltage generator 500, or may receive the correction common voltage supplied from the selector 600.

The timing controller 400 generates a gate control signal (GCS) for controlling an operation timing of the gate driver 200 (i.e., gate driver ICs) and a data control signal (DCS) for controlling an operation timing of the data driver 300 (i.e., data driver ICs) by using a plurality of timing signals, namely, a vertical sync signal (Vsync), a horizontal sync signal (Hsync), a data enable signal (DE), etc., inputted from an external system. Also, the timing controller 400 generates image data to be transferred to the data driver 300.

To this end, as illustrated in FIG. 3, the timing controller 400 includes a receiver 410 that receives input video data and timing signals from the external system, a control signal generator 420 that generates various control signals, a data aligner 430 that realigns the input video data to output the realigned image data, and an output unit 440 that outputs the control signals and the image data.

That is, the timing controller 400 realigns the input video data inputted from the external system according to a structure and characteristic of the panel 100, and transfers the realigned image data to the data driver 300. Such a function may be carried out by the data aligner 430.

The timing controller 400 generates the data control signal (DCS) for controlling the data driver 300 and the gate control signal (GCS) for controlling the gate driver 200 by using the timing signals (i.e., the vertical sync signal (Vsync), the horizontal sync signal (Hsync), the data enable signal (DE), etc.) transferred from the external system, and respectively transfers the control signals to the data driver 300 and the gate driver 200. Such a function may be carried out by the control signal generator 420.

The gate control signal (GCS) generated by the control signal generator 420 includes a gate start pulse (GSP), a gate shift clock (GSC), a gate output enable signal (GOE), a gate start signal (VST), and a gate clock (GCLK).

The data control signal (DCS) generated by the control signal generator 420 includes a source start pulse (SSP), a source shift clock (SSC), the source output enable signal (SOE), and the polarity control signal POL.

Especially, when a data voltage to be outputted to a data line has the positive (+) polarity with respect to the common voltage, the control signal generator 420 outputs the first selection Frame_O to the selector 600, and when the data voltage has the negative (−) polarity with respect to the common voltage, the control signal generator 420 outputs the second selection Frame_E to the selector 600.

For example, under a condition in which the panel 100 is driven in the line inversion system, a data voltage supplied to an odd-numbered line has the positive (+) polarity in a first frame, and a data voltage supplied to an even-numbered line has the negative (−) polarity in the first frame, when input video data corresponding to a data voltage supplied to the odd-numbered line of the first frame is received, the control signal generator 420 generates the first selection Frame_O to transfer the first selection Frame_O to the selector 600, and when input video data corresponding to a data voltage supplied to the even-numbered line of the first frame is received, the control signal generator 420 generates the second selection Frame_E to transfer the second selection Frame_E to the selector 600.

In this case, information on whether the input video data are received may be transferred from the data aligner 430, the receiver 410, or other element of the timing controller 400.

Moreover, the panel 100 is driven in the line inversion system, a data voltage supplied to an odd-numbered line has the negative (−) polarity in a second frame, and a data voltage supplied to an even-numbered line has the positive (+) polarity in the second frame. In this case, when input video data corresponding to a data voltage supplied to the odd-numbered line of the second frame is received, the control signal generator 420 generates the second selection Frame_E to transfer the second selection Frame_E to the selector 600, and when input video data corresponding to a data voltage supplied to the even-numbered line of the second frame is received, the control signal generator 420 generates the first selection Frame_O to transfer the first selection Frame_O to the selector 600.

In addition to the above-described line inversion system, a data voltage having the negative (−) polarity or a data voltage having the positive (+) polarity may be supplied in units of a line according to various inversion systems. In this case, as described above, when input video data for outputting a data voltage having the positive (+) polarity is inputted, the timing controller 400 transfers the first selection signal to the selector 600, and when input video data for outputting a data voltage having the negative (−) polarity is inputted, the timing controller 400 transfers the second selection signal to the selector 600.

Moreover, when input video data corresponding to a positive (+) data voltage is inputted, the timing controller 400 may output a control signal for correcting the input video data, changing the polarity control signal (POL), or controlling a function of the gamma voltage generator, such that a negative (−) data voltage is generated by the data driver 400.

Finally, when the gate-on signal of the scan signal and the first selection signal are inputted, the selector 600 outputs the correction common voltage to the common electrode, and when the gate-on signal of the scan signal and the second selection signal are inputted, the selector 600 outputs the common voltage to the common electrode. Also, when the gate-off signal of the scan signal is inputted, the selector 600 outputs the common voltage to the common electrode.

Here, the correction common voltage denotes a voltage corresponding to the liquid crystal driving voltage having the negative (−) polarity. For example, when the liquid crystal driving voltage is 8 V and the common voltage is 8 V, the liquid crystal driving voltage having the negative (−) polarity may become 0 V, and the liquid crystal driving voltage having the positive (+) polarity may become 16 V.

In this case, the correction common voltage may become 0 V that is the liquid crystal driving voltage having the negative (−) polarity. Therefore, the correction common voltage may become a ground (GND) voltage.

The selector 600, as illustrated in FIG. 2, includes a plurality of switching units 610 that are provided in correspondence with the respective stages which are formed in the gate driver 200 and sequentially output the scan signal. Each of the switching units 610 outputs the correction common voltage or the common voltage to the common electrode 110 by using the scan signal transferred from a corresponding stage 610 and the first or second selection signal.

For example, in a case that desires to display white in a normal black mode, when the correction common voltage of 0 V is outputted through the selector 600, the data driver 300 outputs only a data voltage of 8 V by using the input voltage Vdd of 8 V, thereby displaying white.

In the related art LCD device that is driven with the common voltage of 8 V and the liquid crystal driving voltage of 8 V, the input voltage Vdd of 16 V is needed in the above-described case. However, in the LCD device according to the present invention, as described above, even when the input voltage Vdd of 8 V is used, white can be displayed.

A configuration and function of each of the selector 600 and switching units 610 will be described in detail below with reference to FIGS. 4 to 9.

Figure 4:
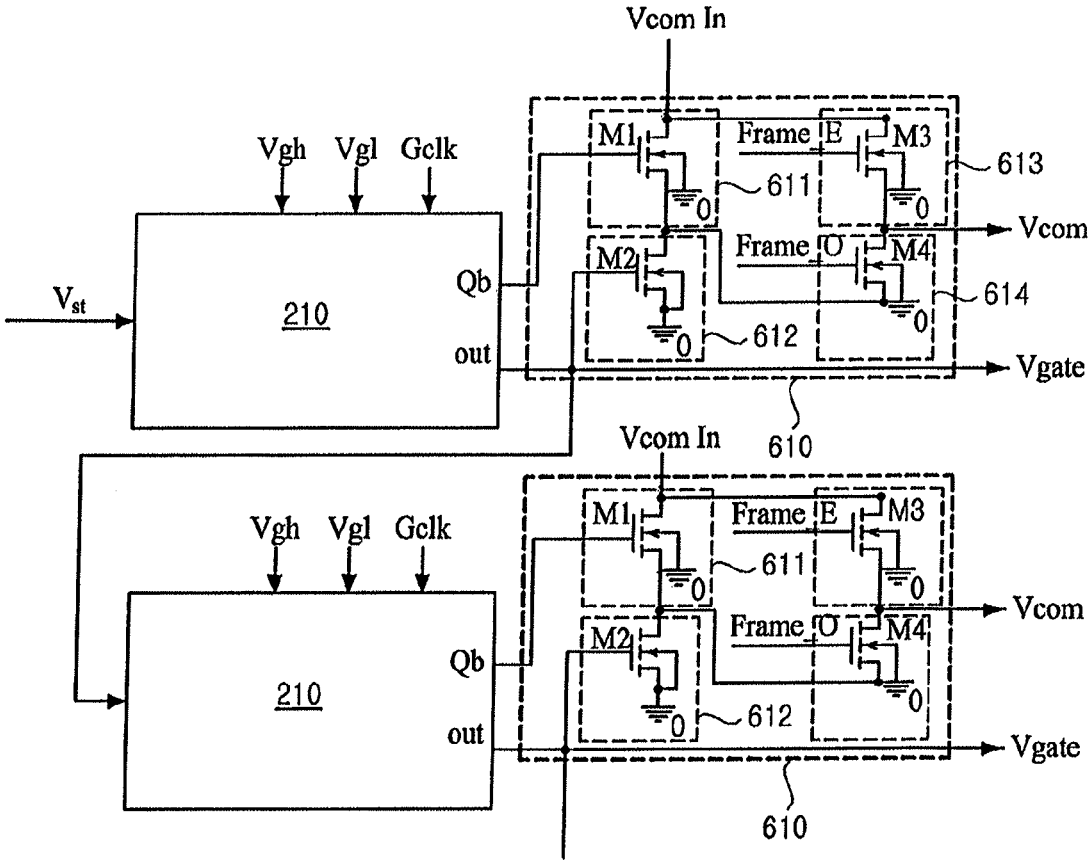
FIG. 4 is a circuit diagram illustrating an embodiment of two switching units included in a selector of FIG. 2.
Figure 5:
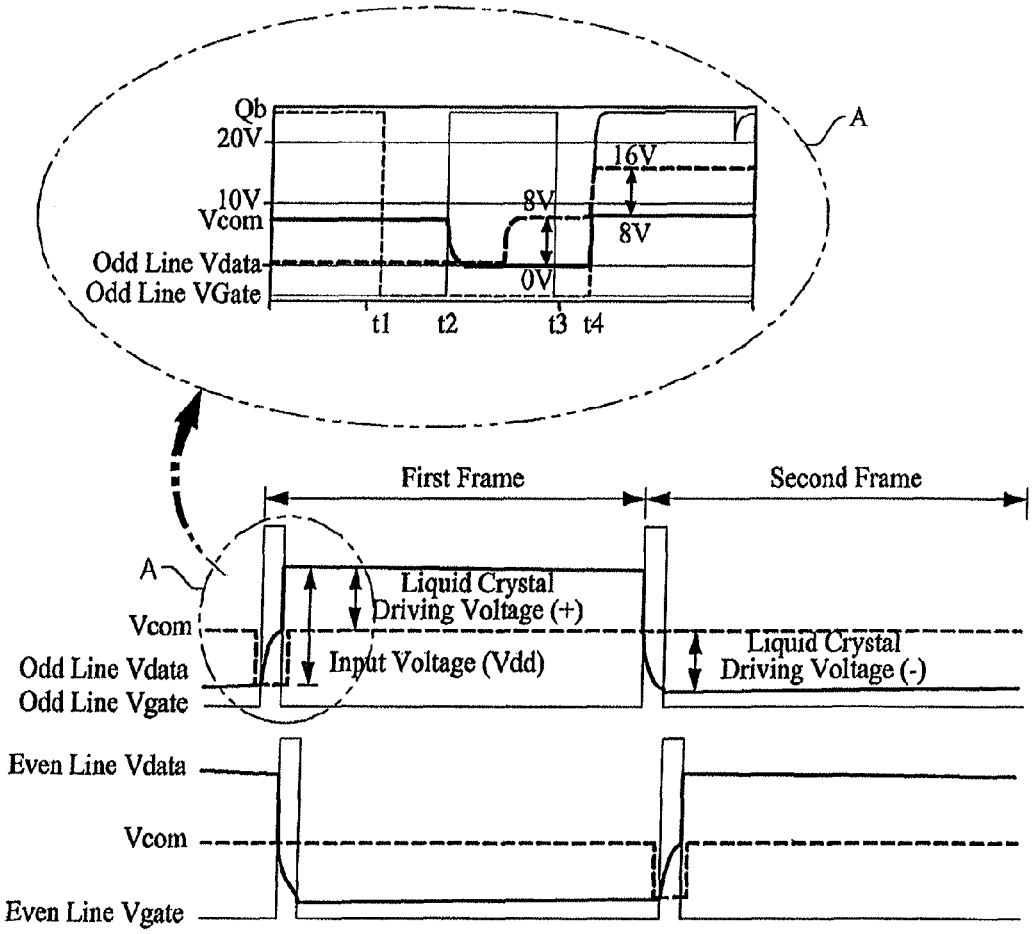
FIG. 5 is an exemplary diagram showing waveforms of a common voltage and data voltages outputted from the LCD device according to the present invention.

FIG. 4 is a circuit diagram illustrating an embodiment of two switching units included in the selector of FIG. 2, FIG. 5 is an exemplary diagram showing waveforms of the common voltage and data voltages outputted from the LCD device according to the present invention, and FIGS. 6 to 9 are exemplary diagrams for describing a method of driving the LCD device according to the present invention.

The switching unit 610 included in the selector 600 will now be described in detail with reference to FIGS. 4 and 5.

The selector 600 is included in the gate driver 200, and includes the plurality of switching units 610 that are provided in correspondence with the respective stages which sequentially output the scan signal.

Each of the switching units 610 outputs the correction common voltage or the common voltage to the common electrode 110 by using the scan signal transferred from a corresponding stage 610 and the first or second selection signal Frame_O or Frame_E.

Each of the switching units 610, as illustrated in FIG. 4, is connected to one stage 210 of the gate driver 200.

Each of the switching units 610 includes a first switch 611 that is turned on according to a reverse scan signal Qb having a waveform opposite to that of the scan signal Out outputted from a corresponding stage 210, a second switch 612 that is turned on according to the scan signal Out outputted from the stage 210, a third switch 613 that is provided between an output terminal and a first node connecting the common voltage generator 500 to the first switch 611 and is turned on according to the second selection signal, and a fourth switch 614 that is provided between the output terminal and a second node connecting the first switch 611 to the second switch 612 and is turned on according to the first selection signal.

The first switch 611 is connected between the common voltage generator 500 and the second switch 612, and the reverse scan signal Qb is inputted to a gate of the first switch 611.

The second switch 612 is connected between the first switch 611 and a ground (0 V) terminal corresponding to the correction common voltage, and the scan signal Out is inputted to a gate of the second switch 612.

The third switch 613 is connected between the first node and the output terminal, and the second selection signal Frame_E is inputted to a gate of the third switch 613.

The fourth switch 614 is connected between the second node and the output terminal, and the first selection signal Frame_O is inputted to a gate of the fourth switch 614.

Here, each of the first to fourth switches 611 to 614 may be configured with a transistor.

The switching unit 610, the second switch 612 is turned on according to the gate-on signal of the scan signal to transfer the correction common voltage (0 V) to the fourth switch 614, and the fourth switch 614 is turned on according to the first selection signal Frame_O to output the correction common voltage (0 V) to the common electrode through the output terminal.

When the second switch 612 is turned on according to the gate-on signal of the scan signal to transfer the correction common voltage to the fourth switch 614, the fourth switch 614 is turned off, and the third switch 613 is turned on according to the second selection signal Frame_E to output the common voltage to the common electrode through the output terminal.

When the first switch 611 is turned on by the reverse scan signal Qb and the first selection signal is inputted, the fourth switch 614 outputs the common voltage to the common electrode, and when the first switch 611 is turned on by the reverse scan signal Qb and the second selection signal is inputted, the third switch 613 outputs the common voltage to the common electrode.

An operation of the switching unit 610 will be described in detail with reference to FIGS. 4 to 9.

Figure 6:
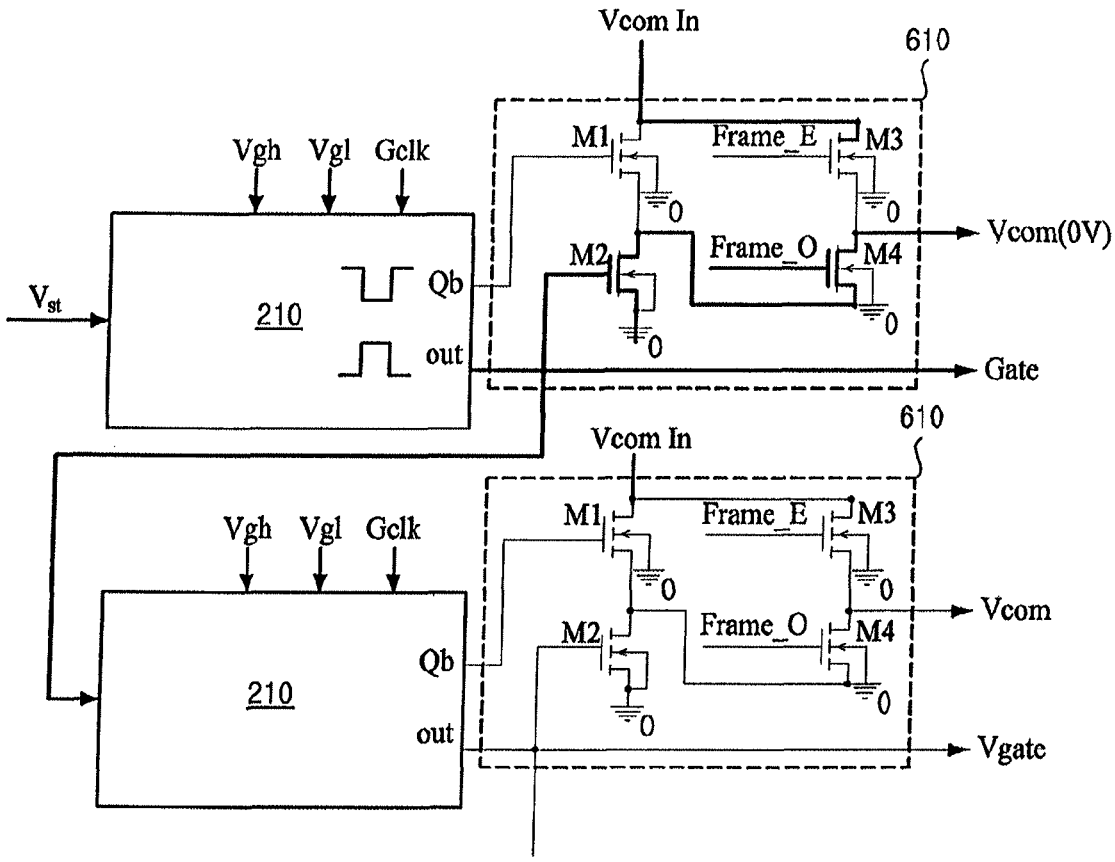
FIGS. 6 to 9 are exemplary diagrams for describing a method of driving the LCD device according to the present invention.

First, referring to FIG. 6, when a high-level gate-on voltage is outputted to a corresponding gate line through a first output terminal Out of the stage 210, the second switch 612 is turned on to supply the correction common voltage (0 V), corresponding to the liquid crystal driving voltage having the negative (−) polarity, to the fourth switch 614.

At this time, when it is determined that a positive (+) data voltage is outputted to a data line, the timing controller 400 outputs the first selection signal Frame_O having a high level to a corresponding switching unit 610.

The first selection signal is inputted to a gate of the fourth switch 614 to turn on the fourth switch 614.

Therefore, the correction common voltage (0 V) is outputted to the common electrode through the fourth switch 614 and the output terminal.

Figure 7:
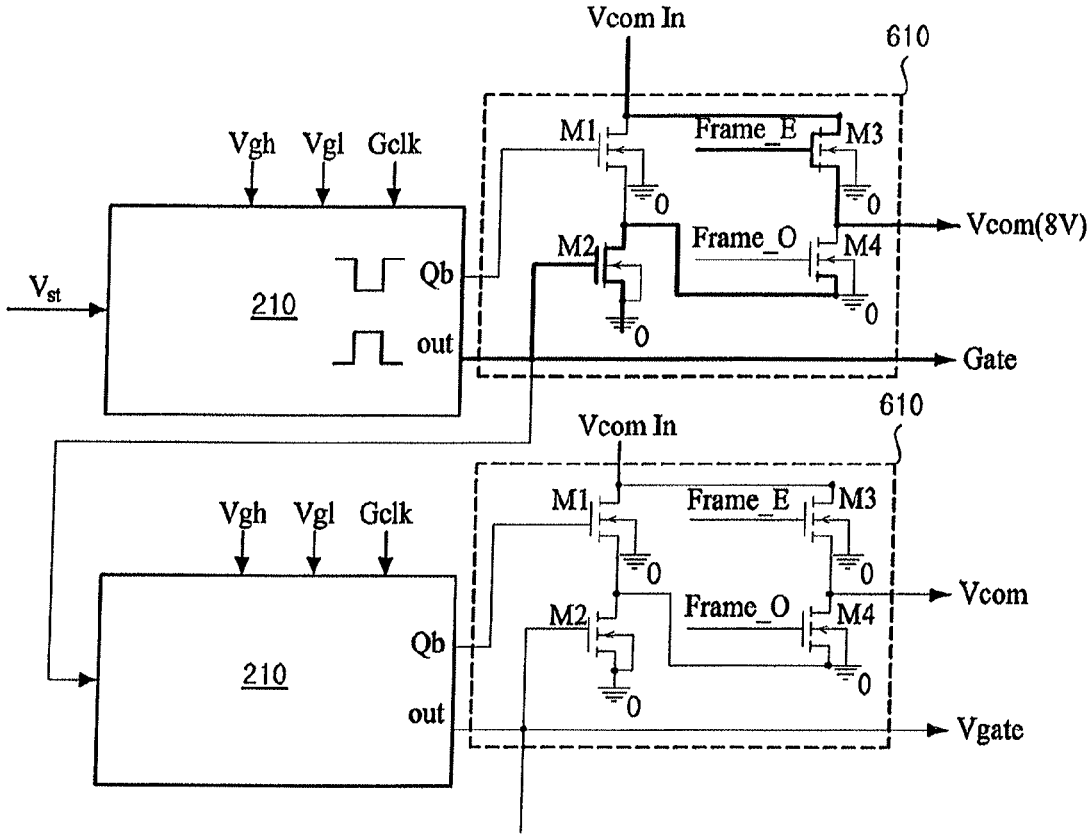

Subsequently, referring to FIG. 7, when the high-level gate-on voltage is outputted to the gate line through the first output terminal Out of the stage 210, the second switch 612 is turned on to supply the correction common voltage (0 V), corresponding to the liquid crystal driving voltage having the negative (−) polarity, to the fourth switch 614.

At this time, when it is determined that a positive (+) data voltage is outputted to the data line, the timing controller 400 outputs the second selection signal Frame_E having a high level to the switching unit 610.

The second selection signal is inputted to a gate of the third switch 613 to turn on the third switch 613.

Therefore, the correction common voltage (0 V) is not outputted through the fourth switch 614, and the common voltage transferred from the common voltage generator 500 is outputted to the common electrode through the third switch 613 and the output terminal.

That is, despite the gate-on voltage being outputted to the gate line, only when a positive (+) data voltage is outputted to the data line (see FIG. 6), the correction common voltage (0 V) is outputted to the common electrode, and only when a negative (−) data voltage is outputted to the data line (see FIG. 7), the common voltage (8 V) is outputted to the common electrode.

When the correction common voltage (0 V) is outputted to the common electrode, a negative (−) data voltage is substantially outputted to the data line.

Figure 8:
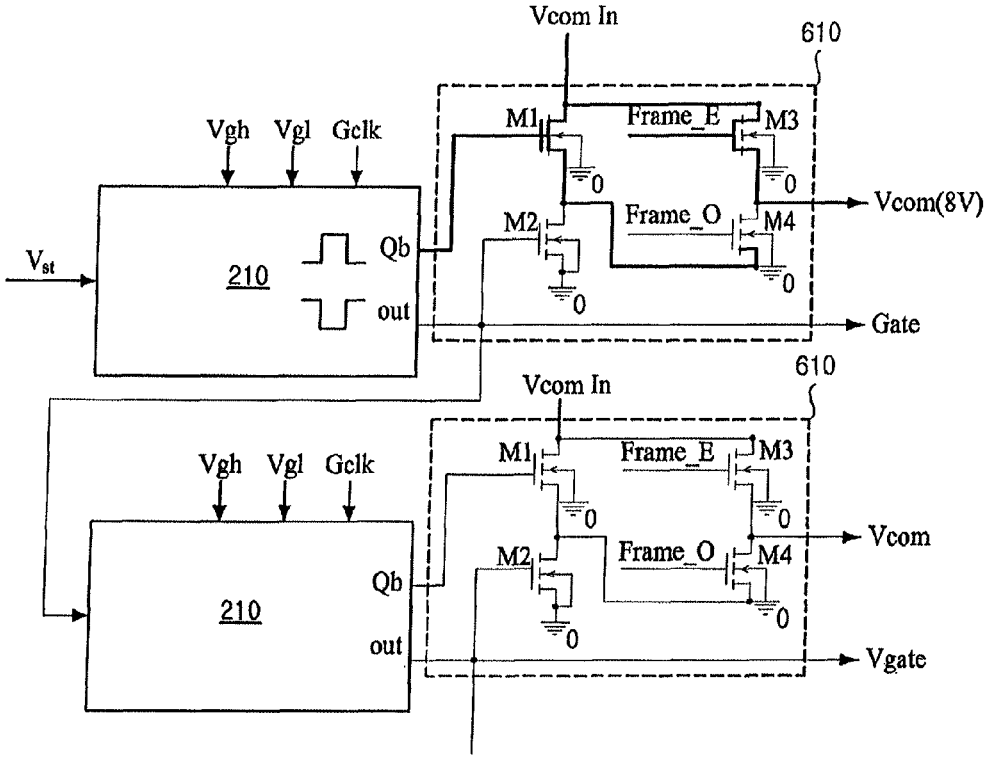
Figure 9:
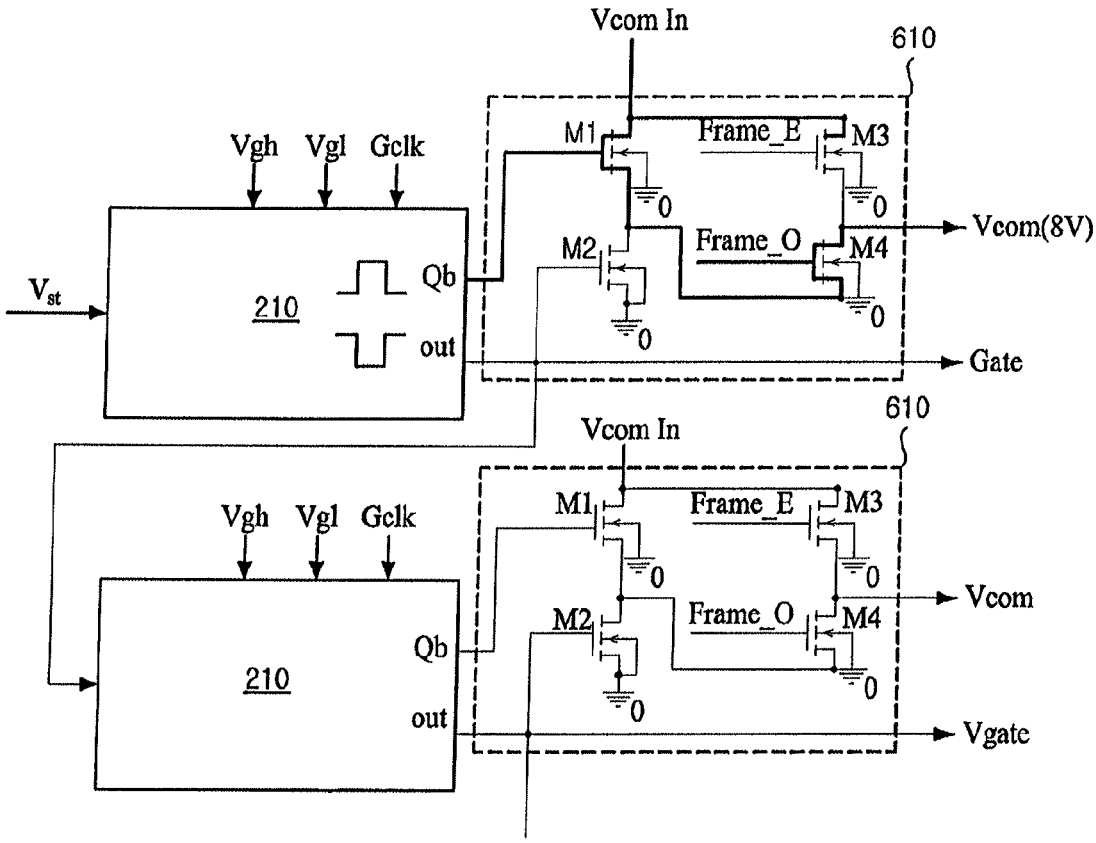

Subsequently, in FIGS. 8 and 9 illustrating a case in which a gate-off voltage is outputted to the gate line, the switching unit 610 outputs the common voltage, transferred from the common voltage generator 500, to the common electrode irrespective of the first selection signal or the second selection being inputted.

That is, when the gate-off voltage having a low level is outputted through the first output terminal Out of the stage 210, the reverse scan signal having a high level is outputted through a second output terminal Qb of the stage 210.

When the first switch 611 is turned on by the reverse scan signal, the common voltage transferred from the common voltage generator 500 may be outputted to the fourth switch 614 or the third switch 613.

At this time, when the timing controller 400 outputs the second selection signal Frame_E to the switching unit 610, as illustrated in FIG. 8, the third switch 613 is turned on, and the common voltage is outputted to the common electrode through the third switch 613.

When the timing controller 400 outputs the first selection signal Frame_O to the switching unit 610, as illustrated in FIG. 9, the fourth switch 613 is turned on, and the common voltage is outputted to the common electrode through the fourth switch 613.

That is, when a gate low voltage is outputted to the gate line, the common voltage (8 V) transferred from the common voltage generator 500 is outputted to the common electrode.

The present invention relates to a scheme in which a data voltage having the negative (−) polarity is used as-is and a data voltage having the positive (+) polarity is applied through charge pumping, and may identically use the liquid crystal driving voltage and the input voltage Vdd. Also, the present invention may perform scanning driving by using a gate-in panel (GIP) and a gate voltage.

Specifically, referring to FIG. 5, the second switch 611 is turned off (Vcom floating) by the reverse scan signal (Qb=low) before the gate-on voltage is outputted (t1), and then, when the gate-on voltage is outputted (t2-t3), the second switch 612 is short-circuited (Vcom=0V) with the gate-on voltage. At this time, a data voltage is charged.

After the gate-on voltage is outputted, namely, when the gate-off voltage is outputted (t4), the first switch 611 is short-circuited (Vcom=8V) by the reverse scan signal (Qb=High). At this time, charge pumping is performed, and a data voltage having the positive (+) polarity becomes 16 V.

According to the present invention, high-voltage driving two times the related art LCD device can be performed, and when the same liquid crystal driving voltage is used, the power consumption of the analog unit of the source driving IC can decrease by about 50%.

Moreover, according to the present invention, a luminance difference between a high luminance and a low luminance due to a pixel charging voltage difference can be improved through the scanning driving.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

a panel comprising a plurality of pixels that are respectively formed in a plurality of areas defined by intersections between a plurality of gate lines and a plurality of data lines;

a data driver configured to output a data voltage to a corresponding data line;

a gate driver configured to sequentially output a scan signal to the plurality of gate lines;

a common electrode formed at the panel in correspondence with each of the pixels;

a common voltage generator configured to generate a common voltage to be supplied to the common electrode;

a timing controller configured to, when the data voltage to be outputted to the data line has a positive polarity with respect to the common voltage, output a first selection signal and, when the data voltage has a negative polarity with respect to the common voltage, output a second selection signal; and a selector configured to output a correction common voltage corresponding to a negative liquid crystal driving voltage to the common electrode by using the scan signal and the first selection signal and to output the common voltage, transferred from the common voltage generator, to the common electrode by using the scan signal and the second selection signal.

2. The LCD device of claim 1, wherein, when a gate-on signal of the scan signal and the first selection signal are inputted, the selector outputs the correction common voltage to the common electrode, when the gate-on signal of the scan signal and the second selection signal are inputted, the selector outputs the common voltage to the common electrode, and when a gate-off signal of the scan signal is inputted, the selector outputs the common voltage to the common electrode.

3. The LCD device of claim 1, wherein, the gate driver comprises a plurality of stages for sequentially outputting the scan signal to the plurality of gate lines;

the selector comprises a plurality of switching units provided in correspondence with respective stages in the plurality of stages, and each of the switching units outputs the correction common voltage or the common voltage to the common electrode by using the scan signal transferred from a corresponding stage and the first or second selection signal.

4. The LCD device of claim 1, wherein the selector comprises a plurality of switching units, each of the switching units comprising:

a first switch configured to tum on according to a reverse scan signal having a waveform opposite to the scan signal outputted from the gate driver;

a second switch configured to tum on according to the scan signal transferred from the gate driver;

a third switch provided between an output terminal and a first node connecting the common voltage generator to the first switch, and configured to turn on according to the second selection signal; and a fourth switch provided between the output terminal and a second node connecting the first switch to the second switch, and configured to turn on according to the first selection signal.

5. The LCD device of claim 4, wherein, the second switch is turned on according to a gate-on signal of the scan signal to transfer the correction common voltage to the fourth switch, and the fourth switch is turned on according to the first selection signal to output the correction common voltage to the common electrode through the output terminal.

6. The LCD device of claim 4, wherein when the second switch is turned on according to the gate-on signal of the scan signal to transfer the correction common voltage to the fourth switch, the fourth switch is turned off, and the third switch is turned on according to the second selection signal to output the common voltage to the common electrode through the output terminal.

7. The LCD device of claim 4, wherein, when the first switch is turned on by the reverse scan signal and the first selection signal is inputted, the fourth switch outputs the common voltage to the common electrode, and when the first switch is turned on by the reverse scan signal and the second selection signal is inputted, the third switch outputs the common voltage to the common electrode.

8. A method of driving a liquid crystal display (LCD) device, the method comprising:

when a data voltage to be outputted to a data line has a positive polarity with respect to a common voltage, generating a first selection signal and, when the data voltage has a negative polarity with respect to the common voltage, generating a second selection signal; and generating a correction common voltage corresponding to a negative liquid crystal driving voltage to a common electrode by using a scan signal outputted to a gate line and the first selection signal and generating the common voltage to the common electrode by using the scan signal and the second selection signal.

9. The method of claim 8, wherein the generating of a correction common voltage or the common voltage comprises:

when a gate-on signal of the scan signal and the first selection signal are inputted, outputting the correction common voltage to the common electrode; and when the second selection signal or a gate-off signal of the scan signal is inputted, outputting the common voltage to the common electrode.

10. The method of claim 9, wherein the outputting of the common voltage comprises:

when the gate-on signal of the scan signal and the second selection signal are inputted, outputting the common voltage to the common electrode; and when the gate-off signal of the scan signal is inputted, outputting the common voltage to the common electrode.

* * * * *